US011041130B2

(12) United States Patent
Koseoglu

(10) Patent No.: US 11,041,130 B2
(45) **Date of Patent: *Jun. 22, 2021**

(54) TWO-STAGE HYDROTREATING PROCESS EMPLOYING MERCAPTANIZATION AND HYDRODESULFURIZATION

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 107 days.

This patent is subject to a terminal disclaimer.

(21) Appl. No.: 16/565,962

(22) Filed: Sep. 10, 2019

(65) Prior Publication Data

US 2021/0071096 A1 Mar. 11, 2021

(51) Int. Cl.
*C10G 67/02* (2006.01)

(52) U.S. Cl.
CPC ..... *C10G 67/02* (2013.01); *C10G 2300/201* (2013.01); *C10G 2300/202* (2013.01); *C10G 2300/207* (2013.01); *C10G 2300/308* (2013.01)

(58) Field of Classification Search
None
See application file for complete search history.

(56) References Cited

U.S. PATENT DOCUMENTS

| | | | |
|---|---|---|---|
| 2,502,596 | A | 4/1950 | Schulze et al. |
| 2,793,170 | A | 5/1957 | Stiles et al. |
| 3,340,184 | A | 9/1967 | Eng et al. |
| 5,770,046 | A | 6/1998 | Sudhakar |
| 6,210,560 | B1 | 4/2001 | Wiehe et al. |
| 7,153,415 | B2 | 12/2006 | Podrebarac et al. |
| 9,951,283 | B2 | 4/2018 | Choi et al. |
| 2006/0151359 | A1 | 7/2006 | Ellis et al. |
| 2012/0273394 | A1 | 11/2012 | Banerjee et al. |
| 2016/0257646 | A1 | 9/2016 | Cazaux et al. |
| 2018/0105756 | A1 | 4/2018 | Gomez et al. |
| 2018/0155640 | A1 | 6/2018 | Dalal et al. |

OTHER PUBLICATIONS

AN-035: Measuring H2S in Hydrogen Recycle Gas, 2013, Applied Analytics, www.a-a-inc.com retrieved (Feb. 24, 2021). (Year: 2013).*
International Search Report and Written Opinion dated Oct. 22, 2020 in corresponding International Application PCT/US2020/047777.

* cited by examiner

*Primary Examiner* — Derek N Mueller
(74) *Attorney, Agent, or Firm* — Abelman, Frayne & Schwab

(57) ABSTRACT

A two-step process for treating a sulfur-containing refinery feedstock that includes olefin and diolefin constituents by reacting the feedstock with hydrogen sulfide over a catalyst to produce the corresponding mercaptans and/or thiophenes, which are then desulfurized in a second reactor containing hydrodesulfurization catalysts, thereby avoiding the need for prior selective hydrogenation of the olefin and diolefin constituents.

31 Claims, 5 Drawing Sheets

TWO-STAGE HYDROTREATING PROCESS EMPLOYING MERCAPTANIZATION AND HYDRODESULFURIZATION

BACKGROUND OF THE INVENTION

Field of the Invention

This disclosure is directed to processes for the desulfurization of distillate streams that contain quantities of olefins and diolefins.

Description of Related Art

The discharge of sulfur-containing compounds into the atmosphere during the processing of petroleum products derived from sulfur-containing sour crude oil poses health and environmental related issues. Stringent low sulfur specifications throughout the world imposed on transportation and other fuel products have impacted the refining industry and refiners have been required to make capital investments in equipment that greatly reduce the sulfur content in gas oils, e.g., to 10 parts per million by weight (ppmw) or less.

In industrialized nations such as the United States, Japan and the countries of the European Union, refineries have been producing environmentally clean transportation fuels. For instance, in 2007, the United States Environmental Protection Agency required the sulfur content of highway diesel fuel to be reduced 97%, from 500 ppmw (low sulfur diesel) to 15 ppmw (ultra-low sulfur diesel). The European Union enacted even more stringent standards, requiring diesel and gasoline fuels sold since 2009 to contain less than 10 ppmw of sulfur. Other countries are following in the footsteps of the United States and the European Union and are moving forward with regulations that will require refineries to produce transportation fuels with ultra-low sulfur levels.

To keep up with current trends of production of ultra-low sulfur fuels, refiners must choose among the available desulfurization processes or initial crude oil sources that provide flexibility to ensure future specifications are met with minimum additional capital, investment. In many instances, this means by utilizing existing equipment already found in the refinery.

Conventional technologies such as hydrocracking and two-stage hydrotreating provide solutions to refiners for the production of clean transportation fuels. These technologies are available and can be applied as new grassroots production facilities are constructed. However, many existing hydroprocessing facilities, such as those using relatively low-pressure hydrotreaters, were constructed before the current low sulfur requirements were enacted and modifying those facilities for such desulfurization processes would represent a substantial investment. It has proven very difficult to upgrade existing hydrotreating reactors in these facilities because of the comparatively more severe operational requirements, i.e., higher temperatures and pressures, required for the production of ultra-low sulfur fuels. Available retrofitting options for refiners include increasing of the hydrogen partial pressure by increasing the recycle gas quality, utilization of more active catalyst compositions, installation of improved reactor components to enhance liquid-solid contact, the increase of reactor volume, and the improvement of the feedstock quality. However, each of these options incurs capital costs and, in some cases, an increase in operating costs.

Currently, many hydrotreating units installed worldwide are producing transportation fuels containing 500-3000 ppmw sulfur. These units were designed for, and are being operated under relatively mild conditions, i.e., low hydrogen partial pressures of for example 30 kg/cm$^2$ for straight run gas oils that boil in the range of from 180° C. to 370° C.

As the more stringent fuel sulfur specification limits of 10 ppmw to 15 ppmw are enacted, continuing operation of older refineries will require either construction of new high-pressure hydrotreating units, or a substantial retrofitting of existing facilities, e.g., by incorporating gas purification systems, reengineering the internal configuration and components of reactors, and/or deployment of more active catalyst compositions.

Feedstocks for distillate hydrotreating units typically include straight run (SR) distillates, fluid catalytic cracking distillates, such as light cycle oil (FCC LCO), thermally cracked distillates, such as delayed coking gas oils, and combinations thereof. The quality and composition of these distillates varies with the distillation range and depends on the source of the initial crude oil and the severity of the processing units. Table 1 summarizes the composition and properties of five types of distillates, and is taken in part from *Technical Review on Flexible Processing Middle Distillate for Achieving Maximum Profit in China*, Appl Petrochem Res (2017) Zhanquan Zhang et al, 7:67-77. The reported data indicates that thermally cracked gas oils such as LCO and LCGO contain more heteroatoms, and particularly those with nitrogen, than straight run gas oils and hydrocracked diesel.

TABLE 1

| | Straight Run Gas Oil (SRGO) | Light Cycle Oil (LCO) | Light Coker Gas Oil (LCGO) | Diesel from Vacuum Gas Oil Hydrocracking (HCD) | Diesel from Residue Hydroprocessing (HCRD) |
|---|---|---|---|---|---|
| Specific Gravity @ 15° | 0.79-0.85 | 0.87-0.93 | 0.82-0.84 | 0.79-0.84 | 0.84-0.87 |
| Sulfur, W % | 200-15000 | 1000-5000 | 1000-9000 | <10 | 50-300 |
| Nitrogen, ppmw | 20-800 | 600-3000 | 1000-4000 | <10 | 40-300 |
| Cetane Number | 50-54 | <35 | 48-51 | >55 | 45-47 |

Sulfur-containing compounds typically present in hydrocarbon fuels include aliphatic molecules such as sulfides, disulfides and mercaptans as well as aromatic molecules such as thiophenes, benzothiophenes and their long-chain alkylated derivatives, and dibenzothiophenes and their alkyl derivatives, for example, 4,6-dimethyl-dibenzothiophene. Aliphatic sulfur-containing compounds are typically classified as labile compounds and are easily desulfurized using mild hydrodesulfurization methods. However, certain highly-branched aromatic molecules can sterically hinder sulfur atom removal during desulfurization processes and are typically classified as refractory compounds.

Among the sulfur-containing aromatic compounds, thiophenes and benzothiophenes are relatively easy to hydrodesulfurize, but with any addition of alkyl group(s) to the ring-structure of these compounds, the difficulty of desulfurization increases. Dibenzothiophenes, which result from the addition of a second ring to the benzothiophene family of compounds, are even more difficult to desulfurize. The difficulty of desulfurizing dibenzothiophenes that are alkyl substituted varies greatly depending on the location alkyl moiety. Alkyl groups at 4 and 6 carbon atoms make the dibenzothiophene molecule difficult to desulfurize due to steric hindrance. These beta-substituents can hinder the exposure of the heteroatom to the active site on the catalyst. Hence, the identification of these compounds as "refractory".

It is becoming exceedingly difficult, therefore, to achieve the economical removal of refractory sulfur-containing compounds in order to meet the ultra-low sulfur levels currently required. Current hydrotreating techniques to treat these refractory compounds are very costly. When previous regulations permitted sulfur levels up to about 500 ppmw, there was little need or incentive to desulfurize beyond the capabilities of conventional hydrodesulfurization units, and therefore the refractory sulfur-containing compounds were not targeted. However, in order to meet the more stringent current sulfur specifications, these refractory sulfur-containing compounds must now be substantially removed from hydrocarbon fuels streams.

FIG. 1 shows the relative reaction rates of certain sulfur compounds plotted as a function of molecule size and relative difficulty of hydrodesulfurization based on data reported in the article entitled "*An overview of new approaches to deep desulfurization for ultra-clean gasoline, diesel fuel and jet fuel*", Catalysis Today, 86 (2003) Song, pp. 211-263. As shown, mercaptans, thiols and sulfides are much more reactive than aromatic sulfur compounds.

Cracked distillates require different and typically more severe, hydrotreating processes than straight-run naphtha. For example, light coker gas oil (LCGO) that boils in the diesel boiling range requires relatively higher operating pressures during hydrotreating than straight-run diesel because of the higher nitrogen content in the LCGO.

Thermal cracking, e.g., coking processes, visbreaking process, and the like, are widely practiced in the refining industry to convert petroleum residuum, e.g., atmospheric or vacuum residues, at high temperatures into liquid and gas products. For example, in a delayed coking process, a residue is thermally cracked at temperatures in the range of from 485° C. to 505° C. in relatively short residence times in the furnace tubes and in longer residence times in the downstream coke drums. The cracked distillates, comprising hydrocarbons boiling in the range from about 36° C. to 400° C., typically contains up to 20 times more sulfur and higher levels of nitrogen than straight-run distillates.

The cracked distillates also have high concentrations of olefins and diolefins that can negatively impact downstream processes such as hydrotreating, e.g., hydrodesulfurization (HDS). Due to the high concentration of impurities in the cracked distillates, the downstream hydrotreater requires a different configuration and more severe operating conditions in order to meet product environmental specifications.

The olefins and diolefins present in the cracked distillates are typically selectively hydrogenated prior to the downstream hydrodesulfurization step because these olefinic components are known to polymerize and to deactivate the HDS catalyst. Olefin hydrogenation is highly exothermic and selective hydrogenation therefore results in large temperature differentials across the reactor or catalyst bed. If the olefins and diolefins are not selectively hydrogenated they will react to form long chain polymers, commonly referred to as gums, which are known to foul catalysts and process equipment.

It is reported in U.S. Pat. No. 6,210,560, which is incorporated herein by reference, that these polymerization reactions occur at a significant rate in the temperature range of 232° C. to 304° C. when the iodine value, a diolefin indicator, is 4 g/100 g of oil. At temperatures below this range, the reaction rate is too slow for significant polymerization to occur. The iodine value was calculated in accordance with the known UOP test method number 326.

It is stated in published US 2012/0273394, the disclosure of which is incorporated herein by reference, that the fouling tendencies of distillates is commercially acceptable when the iodine diolefin indicator value is less than about 2 g/100 g of oil.

A similar test protocol can be applied to determine the bromine number which is a measure of olefin content of a hydrocarbon sample. The bromine number can be obtained via known methods, including ASTM D1159-01. When the bromine number is greater than 1 g/100 g of oil, the olefin content in the feedstream will polymerize and gumming will occur.

The maleic anhydride test value is known as a suitable measure of the content of conjugated dienes present in a specified quantity of a fuel sample. In order to obtain the maleic anhydride value of a fuel, the sample is refluxed with a known excess of maleic anhydride which undergoes the Diels-Alder reaction with any conjugated diolefins present in the fuel sample. The unreacted maleic anhydride remaining is then hydrolyzed to maleic acid, which in turn is quantified by titration with a strong base, such as sodium hydroxide. The amount of maleic anhydride consumed in the Diels-Alder reaction is calculated and the value is the measure of the amount of conjugated dienes present in the fuel sample. The result is reported as a diene value, which is defined as the number of grams of 12 equivalent to the amount of maleic anhydride, on a 1:1 molar basis, that reacts with 100 g of sample.

A typical hydrotreating unit for treating a cracked distillate feed comprises two or three stages. Diolefins are hydrogenated in the first stage, which can be operated at a relatively lower temperature, and olefins are hydrogenated over special catalysts to a saturated species in the second stage. The hydrogenated distillate, free of olefins, is then sent to a third stage for sulfur and/or nitrogen removal.

Thermally cracked olefin- and diolefin-containing hydrocarbon streams have to be selectively hydrogenated prior to the hydrodesulfurization step in order to avoid polymerization and gum formation.

An improved process is needed to more efficiently and cost-effectively remove olefins and diolefins from distillate streams prior to hydrodesulfurization processing in order to avoid or minimize deactivation of the hydrodesulfurization catalysts than is currently available in the art and that employ a two- or three-stage hydrogenation process.

SUMMARY OF THE INVENTION

The above needs are met and other advantages are provided by the process of the present disclosure that advantageously converts olefins and/or diolefins present in sulfur-containing refinery distillate streams via a mercaptanization and/or thiophenization reaction to provide an olefin-free sulfur-containing stream for processing in the hydrodesulfurization unit.

Olefin Mercaptanization

The mercaptanization reaction is well known in the refining art. The process is described in U.S. Pat. No. 2,502,596, entitled "Reaction of Hydrogen Sulfide with Olefins", which is incorporated herein by reference, and describes the reactions and representative operating conditions. A more recent patent application, US 2016/0257646, "Method for Synthesizing a Mercaptan by Adding Hydrogen Sulfide to an Olefin", which is also incorporated herein by reference, describes a method for synthesizing a mercaptan from a terminal olefin using hydrogen sulfide and comprises the following consecutive steps: (1) catalytic addition of hydrogen sulfide to a terminal olefin, in the presence of an acid catalyst; (2) separation of the products into a light fraction that includes the excess hydrogen sulfide and the olefins, and a heavy fraction that includes at least one mercaptan and, optionally, one or more thioethers.

It has been found that when olefins are converted, there is a substantial increase in the boiling points of the corresponding mercaptans. Table 2 summarizes the boiling points of C5-C7 olefins and their corresponding thiols. When 1-pentene, 1-hexene and 1-heptene are converted to their corresponding thiols, their boiling points increase by 96° C., 87° C. and 83° C., respectively. The substantial increase in boiling points greatly facilitates the separation of the thiols from the remaining hydrocarbons.

TABLE 2

| Carbon Number | Olefin, ° C. | Thiol, ° C. | ΔT, ° C. |
|---|---|---|---|
| 5 | 30 | 126 | 96 |
| 6 | 63 | 150 | 87 |
| 7 | 94 | 177 | 83 |

The thiophenization reaction is also known in the art. Thiophenization reactions typically involve the formation of thiophene through the addition of $H_2S$ to dienes in the presence of acid catalysts such as silica-alumina, alumina, silica-titania, or zeolites with acidity modifiers with active phase metals. For example, thiophene ($C_4H_4S$) can be synthesized from the catalytic addition of hydrogen sulfide to butadiene. The catalyst can be a metal catalyst from IUPAC Groups 4-12 of the Periodic Table possessing acidity, such as nickel, molybdenum, and tungsten, on a support.

The so-called MEROX process is a proprietary catalytic mercaptan oxidation process widely used in petroleum refineries and natural gas processing plants to remove mercaptans contained in end-products such as LPG, propane, butanes, light naphtha, kerosene and jet fuel by converting them into liquid hydrocarbon disulfides. The MEROX designation is derived from the mercaptan oxidation step of the process. It is an integrated process comprising the mercaptan extraction step in which mercaptans react with an aqueous caustic solution in the presence of a catalyst to form an alkylthiolate with a base which is then oxidized in a wet air oxidation step to produce disulfide oils and a regenerated caustic solution that is recycled to the extraction step. The alkaline environment required in some versions of the practice of the MEROX process is provided by an aqueous solution of sodium hydroxide (NaOH), a strong base, or in other versions of the process, by ammonia, which is a relatively weaker base than sodium hydroxide, but which is highly volatile and must be handled with special care due to its irritant and toxicity properties.

In accordance with the present disclosure, sulfur-containing cracked distillates are desulfurized in a two-step process. In the first step, olefins and diolefins present in the distillate stream react with hydrogen sulfide over a catalyst to produce the corresponding mercaptans and/or thiophenes. In the second step, the mercaptans and/or thiophenes, which are easier to desulfurize than their olefin and/or diolefin counterparts, are then desulfurized in the second reactor containing hydrodesulfurization catalysts.

The present process will hydrodesulfurize the olefin and diolefin containing stream without the need for prior selective hydrogenation. The reaction proceeds with less heat generated in the hydrodesulfurization reactor, which facilitates the control of the reactor temperature. The thiophenization and mercaptanization steps can be conducted at high space velocities so that the reactor(s) can be smaller than the selective hydrogenation reactors of the prior art, resulting in a reduction of capital cost.

As used herein, the term "substantially olefin-free stream" means a stream with a bromine number of less than 1 g/100 g hydrocarbon oil.

As used here, the term "substantially diolefin-free stream" means a stream having a maleic anhydride/iodine value of less than 4 g/100 g hydrocarbon oil.

BRIEF DESCRIPTION OF THE DRAWINGS

The process of the present disclosure will be described in more detail below and with reference to the attached drawings in which the same number is used for the same or similar elements, and where.

DETAILED DESCRIPTION OF PREFERRED EMBODIMENTS

Figure 1:
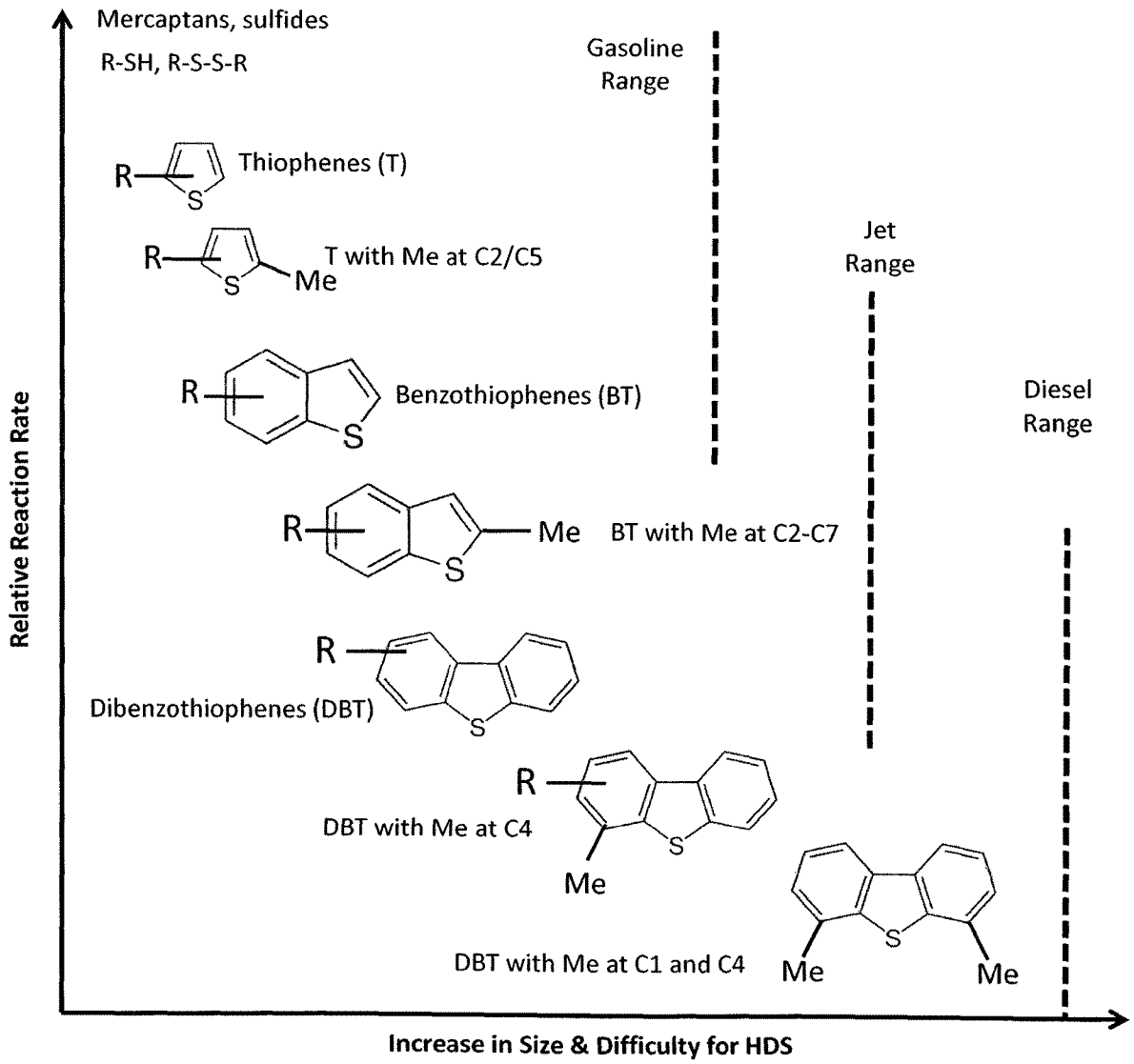
Fig. 1 PRIOR ART
FIG. 1 is a graph based on prior art data illustrating the relative reaction rates of certain sulfur compounds as a function of molecule size and difficulty of hydrodesulfurization.
Figure 2:
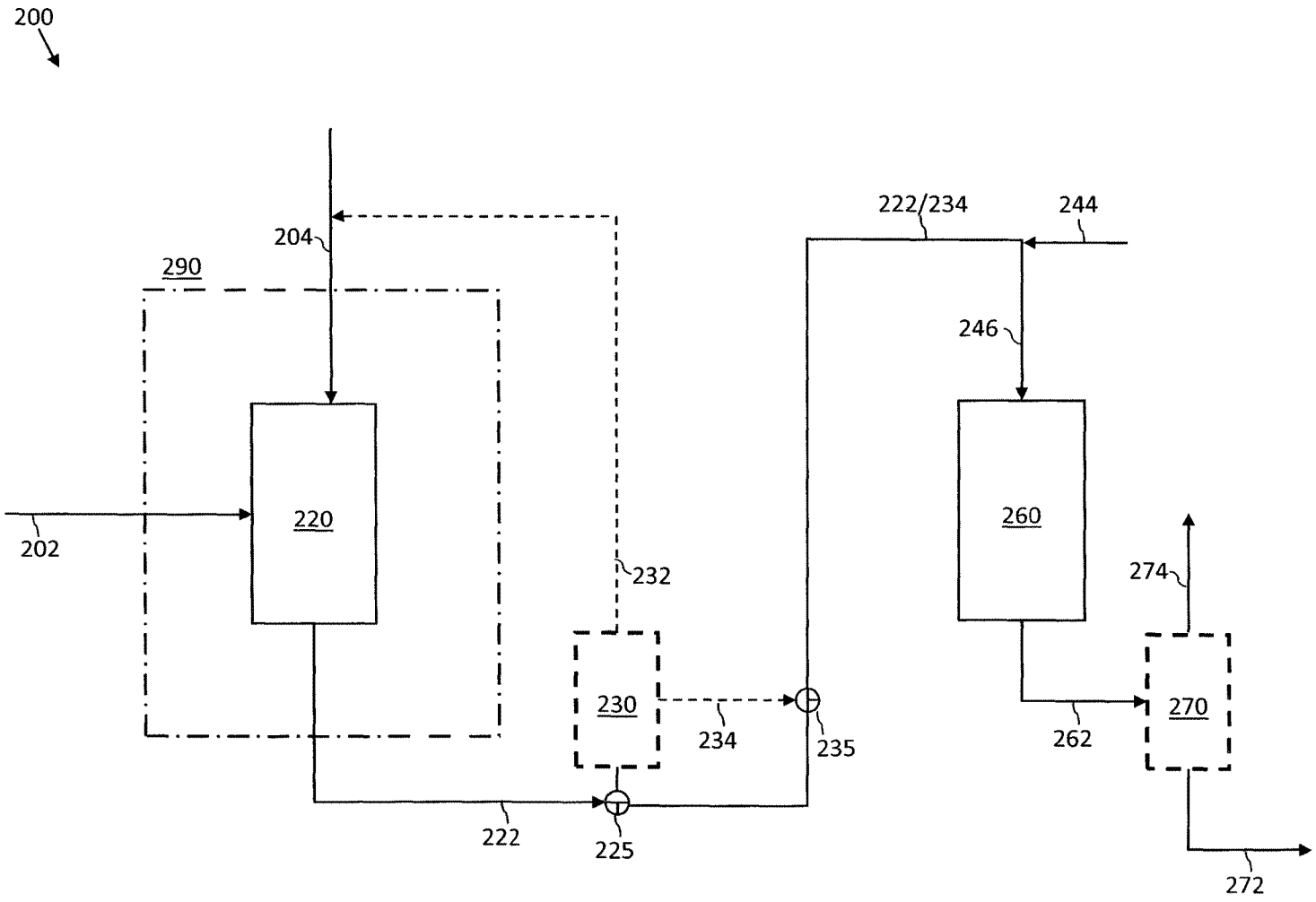
FIG. 2 is a simplified schematic diagram of a first embodiment of the process of the present disclosure.

Referring now to FIG. 2, an embodiment, which will be referred to as "Embodiment 1", of the process and system (200) of the present disclosure includes an unsaturated hydrocarbon treatment zone (290), and hydrodesulfurization zone (260), optionally a hydrogen sulfide separation zone (230) and optionally, a gas-liquid separation zone (270). Embodiment 1 is particularly useful for the treatment of feeds exhibiting a maleic anhydride test value that is less than a predetermined value, e.g., less than 4 mg/g indicating a relatively low concentration of diolefins. In Embodiment 1, unsaturated hydrocarbon treatment zone (290) comprises a mercaptanization unit (220).

An unsaturated hydrocarbon feed (202) comprising olefins and hydrogen sulfide stream (204) are introduced into mercaptanization unit (220) to convert olefins present in the feed (202) into mercaptans and thereby produce a mercaptanized effluent stream (222) that is substantially free of olefins, e.g., having a bromine number of less than 1 g/100 g oil. The mercaptanized effluent stream (222) is mixed with hydrogen (244) and introduced into a hydrodesulfurization zone (260) as mixed stream (246) for desulfurization to produce a hydrodesulfurized effluent stream (262), which is recovered.

In an alternative embodiment, hydrodesulfurized effluent stream (262) is optionally introduced into the gas-liquid separation zone (270) for separation and recovery of off-gas stream (274) and a desulfurized liquid product (272), which is recovered for downstream processing, e.g., for the production of ultra-low sulfur transportation fuels. Off gas stream (274) can include C1-C4, $H_2S$ and $NH_3$. Desulfurized hydrocarbon product (272) comprises naphtha and diesel streams.

In Embodiment 1, the mercaptanized effluent stream (222) can optionally be introduced via a three-way valve (225) into the hydrogen sulfide separation zone (230) for the separation and recovery of a hydrogen sulfide recycle stream (232) and a liquids effluent stream (234), discharged via a three-way valve (235), which is then mixed with hydrogen (244) and introduced into a hydrodesulfurization zone (260) as mixed stream (246). The hydrogen sulfide recovered can be optionally returned to the unsaturated hydrocarbon treatment zone (290) as recycle hydrogen sulfide stream (232) to supplement the hydrogen sulfide stream (204). The optional hydrogen sulfide separation zone (230) can include separation units such as flash units, gas-liquid separators, and the like.

Figure 3:
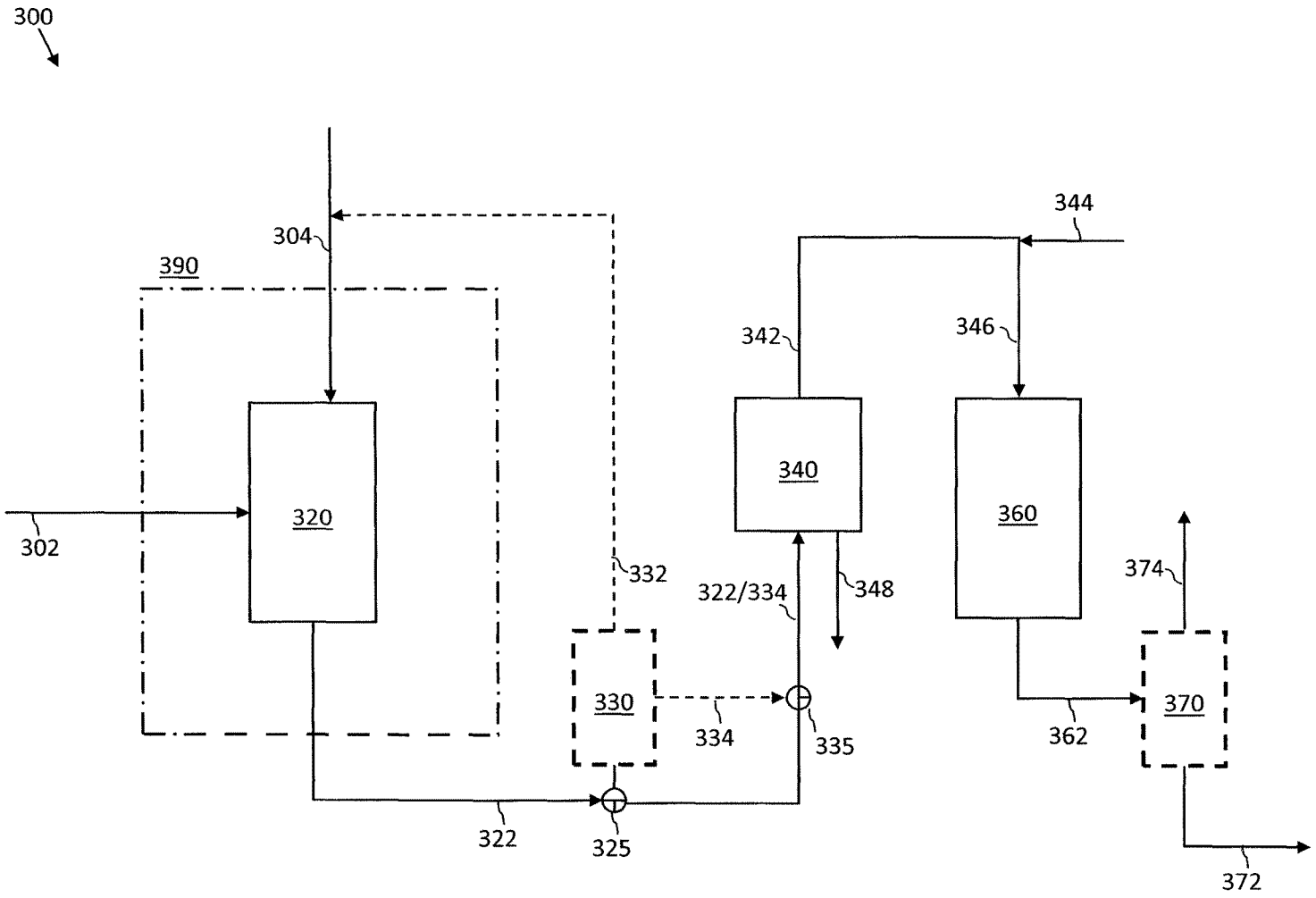
FIG. 3 is a simplified schematic diagram of a second embodiment of the process of the present disclosure.

Referring now to FIG. 3, an embodiment, which will be referred to as "Embodiment 2", of the process and system (300) of the present disclosure includes an unsaturated hydrocarbon treatment zone (390), and hydrodesulfurization zone (360), a mercaptan oxidation, or MEROX zone, (340), optionally a hydrogen sulfide separation zone (330) and optionally, a gas-liquid separation zone (370). Embodiment 2 is particularly useful for the treatment of feeds exhibiting a maleic anhydride test value that is less than a predetermined value, e.g., less than 4 mg/g indicating a relatively low concentration of diolefins and where sweetening is required. In Embodiment 2, unsaturated hydrocarbon treatment zone (390) comprises a mercaptanization unit (320).

An unsaturated hydrocarbon feed (302) comprising olefins and hydrogen sulfide stream (304) are introduced into mercaptanization unit (320) to convert olefins present in the feed (302) into mercaptans and thereby produce a mercaptanized effluent stream (322) that is substantially free of olefins, e.g., having a bromine number of less than 1 g/100 g oil. The mercaptanized effluent stream (322) is introduced into the mercaptan oxidation zone (340) to convert mercaptans into disulfide oils, which are recovered as stream (348). The remaining stream comprising other sulfur containing compounds including sulfides, thiophenes, dibenzothiophenes and their alkylated forms (342) is mixed with hydrogen (344) and introduced into a hydrodesulfurization zone (360) as stream (346) for desulfurization to produce a hydrodesulfurized effluent stream (362).

In an alternative embodiment, hydrodesulfurized effluent stream (362) is optionally introduced into the gas-liquid separation zone (370) for separation and recovery of off gases (374) and a desulfurized product (372), which is recovered for downstream processing, e.g., for the production of ultra-low sulfur transportation fuels. Off-gas stream (374) can include C1-C4, $H_2S$ and $NH_3$. Desulfurized hydrocarbon product (372) comprises naphtha and diesel streams.

The by-product disulfide oils (348) produced by the mercaptan oxidation unit can be processed and/or disposed of in other downstream refinery unit operations (not shown).

In Embodiment 2, the mercaptanized effluent stream (322) can optionally be introduced via a three-way valve (325) into the hydrogen sulfide separation zone (330) for the separation and recovery of a hydrogen sulfide stream (332) and a liquids effluent stream (334), discharged via a three-way valve (335), which is then fed to the MEROX zone (340). The hydrogen sulfide recovered can be optionally returned to the unsaturated hydrocarbon treatment zone (390) as recycle hydrogen sulfide stream (332) to supplement the hydrogen sulfide stream (304). The optional hydrogen sulfide separation zone (330) can include separation units such as flash units, gas-liquid separators, and the like.

Figure 4:
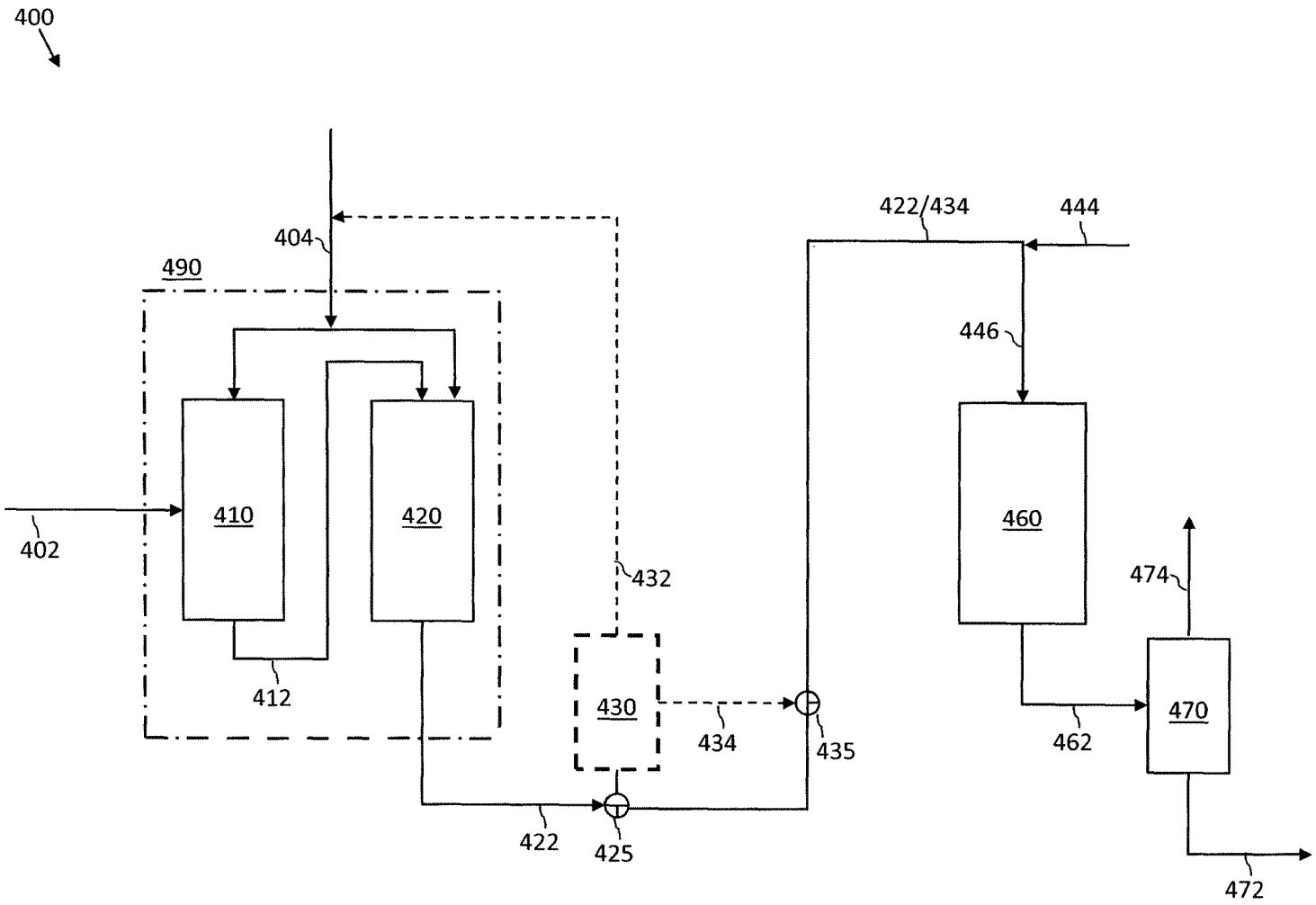
FIG. 4 is a simplified schematic diagram of a third embodiment of the process of the present disclosure.

Referring now to FIG. 4, an embodiment, which will be referred to as "Embodiment 3", of the process and system (400) of the present disclosure includes an unsaturated hydrocarbon treatment zone (490), and hydrodesulfurization (HDS) zone (460), a gas-liquid separation zone (470) and optionally a hydrogen sulfide separation zone (430). The system of Embodiment 3 is preferably employed to treat feeds that exhibit a maleic anhydride test value that is greater than a predetermined value, e.g., equal to or greater than 4 mg/g, that indicates a concentration of dienes that will adversely affect the useful life of the catalyst(s) in the HDS zone. In Embodiment 3, unsaturated hydrocarbon treatment zone (490) comprises a thiophenization unit (410) and a mercaptanization unit (420).

An unsaturated hydrocarbon feed (402) comprising predetermined proportions of a mixture of olefins and diolefins and a hydrogen sulfide stream (404) are introduced into thiophenization unit (410) to convert diolefins in the feed (402) into thiophenes and thereby produce a thiophenized effluent stream (412) that contains olefins that is substantially free of diolefins, e.g., having a maleic anhydride value of less than 4 g/100 g oil. The thiophenized effluent stream (412) that contains olefins and a hydrogen sulfide stream (404) are introduced into mercaptanization unit (420) to produce a mercaptanized and thiophenized effluent stream (422) that is substantially free of olefins and diolefins, e.g., having a bromine number of less than 1 g/100 g oil and a maleic anhydride value of less than 4 g/100 g oil. The mercaptanized and thiophenized effluent stream (422) is mixed with hydrogen (444) and introduced into a hydrodesulfurization zone (460) as mixed stream (446) for desulfurization to produce a hydrodesulfurized effluent stream (462).

In some embodiments, hydrodesulfurized effluent stream (462) is optionally introduced into the gas-liquid separation zone (470) for the separation and recovery of off-gas stream (474), and a desulfurized hydrocarbon product (472), which is recovered for downstream processing, e.g., for the production of ultra-low sulfur transportation fuels. Off-gas stream (474) can include C1-C4, $H_2S$ and $NH_3$. Desulfurized hydrocarbon product (472) comprises naphtha and diesel streams.

In Embodiment 3, the mercaptanized and thiophenized effluent stream (422) can optionally be introduced via a three-way valve (425) into hydrogen sulfide separation zone (430) for the separation of a hydrogen sulfide stream (432) and a liquids effluents stream (434), discharged via three-way valve (435), which is then mixed with hydrogen (444) and introduced into a hydrodesulfurization zone (460) as mixed stream (446). The hydrogen sulfide can optionally be returned to the unsaturated hydrocarbon treatment zone (490) as hydrogen sulfide recycle stream (432) to supplement hydrogen sulfide stream (404). Optional hydrogen sulfide separation zone (430) can comprise separation units such as flash units, gas-liquid separators, and the like.

Figure 5:
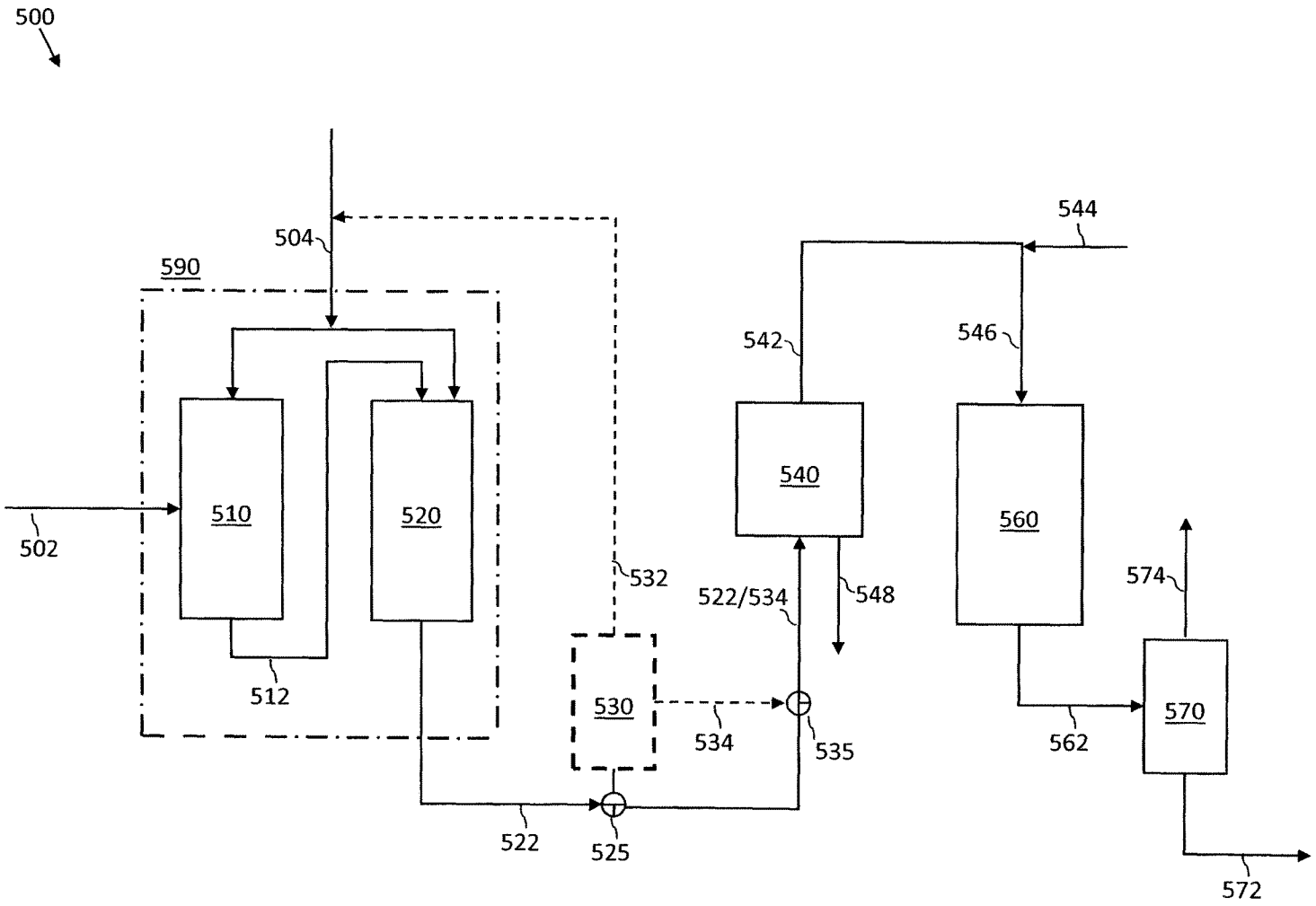
FIG. 5 is a simplified schematic diagram of a fourth embodiment of the process of the present disclosure.

Referring now to FIG. 5, an embodiment, which will be referred to as "Embodiment 4", of the process and system (500) of the present disclosure includes an unsaturated hydrocarbon treatment zone (590), and a mercaptan oxidation or MEROX zone (540), a hydrodesulfurization zone (560), a gas-liquid separation zone (570) and, optionally, a hydrogen sulfide separation zone (530). Embodiment 4 can be used for feeds which exhibit a maleic anhydride test value that is greater than a predetermined value, e.g., equal to or greater than 4 mg/g. In Embodiment 4, unsaturated hydrocarbon treatment zone (590) comprises a thiophenization unit (510) and a mercaptanization unit (520).

An unsaturated hydrocarbon feed (502) comprising diolefins and olefins, and hydrogen sulfide stream (504) are introduced into thiophenization unit (510) to convert diolefins in the feed (502) into thiophenes and thereby produce a thiophenized effluent stream (512) that is substantially free of diolefins, e.g., having a maleic anhydride value of less than 4 g/100 g oil. The thiophenized effluent stream (512) containing olefins and a hydrogen sulfide stream (504) are introduced into mercaptanization unit (520) to produce a mercaptanized and thiophenized effluent stream (522) that is substantially free of olefins and diolefins, e.g., having a bromine number of less than 1 g/100 g oil and a maleic anhydride value of less than 4 g/100 g oil. The mercaptanized and thiophenized effluent stream (522) is introduced into the mercaptan oxidation zone (540) to convert mercaptans into disulfide oils, which are recovered as stream (548). The remaining stream comprising other sulfur containing compounds including, sulfides, thiophenes, benzothiophenes, dibenzothiophenes (542) is mixed with hydrogen (544) and introduced into a hydrodesulfurization zone (560) as stream (546) for desulfurization to produce a hydrodesulfurized effluent stream (562).

Hydrodesulfurized effluent stream (562) is introduced into the gas-liquid separation zone (570) for separation and recovery of off-gas stream (574) and a desulfurized product (572), which is recovered for downstream processing, e.g., for the production of ultra-low sulfur transportation fuels. Off-gas stream (574) includes C1-C4, $H_2S$ and $NH_3$. Desulfurized hydrocarbon product (572) comprises naphtha and diesel streams.

The by-product disulfide oils (548) produced by the mercaptan oxidation unit can be processed and/or disposed of in other downstream refinery unit operations (not shown).

In Embodiment 4, the mercaptanized and thiophenized effluent stream (522) can optionally be introduced via a three-way valve (525) into hydrogen sulfide separation zone (530) for the separation of a hydrogen sulfide stream (532) and a liquids effluents stream (534), discharged via a three-way valve (535), which is then fed into mercaptan oxidation zone (540). The hydrogen sulfide can optionally be returned to the unsaturated hydrocarbon treatment zone (590) as hydrogen sulfide recycle stream (532) to supplement hydrogen sulfide stream (504).

The optional hydrogen sulfide separation zone (530) can include separation units such as flash units, gas-liquid separators, and the like.

As explained previously, Embodiments 1 and 2 are particularly useful for the treatment of feeds exhibiting a maleic anhydride test value that is less than 4 mg/g indicating a relatively low concentration of diolefins and Embodiments 3 and 4 are particularly useful for the treatment of feeds exhibiting a maleic anhydride test value that is equal to or greater than 4 mg/g. However, it will be understood that any of the Embodiments can be used with a feeds exhibiting any maleic anhydride test value. For example, Embodiments 1 and 2 can be used with feeds exhibiting a maleic anhydride test values that are equal to or greater than 4 mg/g, but the catalyst will deactivate faster resulting in fouling and a shorter unit cycle. Additionally, Embodiments 3 and 4 can be used with feeds exhibiting a maleic anhydride test value that is less than 4 mg/g, which would result in longer unit cycles.

Both the mercaptanization and thiophenization units can be operates as fixed bed reactors.

The mercaptanization unit can operate at temperatures in the range of from 80° C. to 300° C., 150° C. to 300° C., or 200° C. to 300° C.; at pressures in the range of from 10 bars to 50 bars, 10 bars to 30 bars, or 10 bars to 20 bars; at a liquid hourly space volume (LHSV) in the range of from 1 $h^{-1}$ to 100 $h^{-1}$, 2 $h^{-1}$ to 40 $h^{-1}$, or 5 $h^{-1}$ to 30 $h^{-1}$; and at hydrogen sulfide-to-olefin molar ratios in the range of from 1:1 to 100:1, 1:1 to 5:1, or 1:1 to 2:1.

A suitable catalyst for use in the mercaptanization unit is an active phase metal catalyst where the metal is selected from Periodic Table IUPAC Groups 4-11 on an alumina, silica, silica-alumina, titania, or zeolite support.

The thiophenization unit can operate at temperatures in the range of from 80° C. to 250° C., 150° C. to 225° C., or 150° C. to 200° C.; at pressures in the range of from 10 bars to 50 bars, 10 bars to 30 bars, or 10 bars to 20 bars; at an LHSV in the range of from 1 $h^{-1}$ to 100 $h^{-1}$, 2 $h^{-1}$ to 40 $h^{-1}$, or 5 $h^{-1}$ to 30 $h^{-1}$; and at a hydrogen sulfide-to-diolefin molar ratios in the range of from 1:1 to 100:1, 1:1 to 5:1, or 1:1 to 2:1.

A suitable catalyst for use in the thiophenization unit is an active phase metal catalyst where the metal is selected from Periodic Table IUPAC Groups 4-11 on an alumina, silica, silica-alumina, titania, or zeolite support.

The hydrodesulfurization zone utilizes hydrotreating catalyst(s) having one or more active metal components selected from the Periodic Table of the Elements Group 6-10. In certain embodiments the active metal component is one or more of cobalt, nickel, tungsten and molybdenum, typically deposited or otherwise incorporated on a support, e.g., alumina, silica alumina, silica, or zeolites. In certain embodiments, the hydrotreating catalyst used in the hydrodesulfurization zone includes a combination of cobalt and molybdenum, nickel and molybdenum or cobalt, nickel and molybdenum deposited on an alumina substrate.

The operating conditions of the hydrodesulfurization zone will vary and the range of operating conditions are dependent on the characteristics of the feedstocks being processed and their determination is within the skill of the art.

For most streams, operating conditions can be used that include an operating temperature of 420° C. and below, a hydrogen partial pressure of 80 bars and below, and a hydrogen feed rate of or below 1000 liters per liter of oil. In certain embodiments of the present process, the operating conditions are: a temperature in the range of from about 300° C. to about 400° C., and in certain embodiments about 320° C. to about 380° C.; a reaction pressure in the range of from about 10 bars to about 40 bars, in certain embodiments about 20 bars to about 40 bars and in further embodiments about 30 bars; a hydrogen partial pressure greater than about 35 bars in certain embodiments, and up to about 55 bars in other embodiments; a feedstock liquid hourly space velocity (LHSV) less than or equal to about 10 $h^{-1}$, in certain embodiments in the range of from about 0.5 $h^{-1}$ to about 10 $h^{-1}$, and in certain embodiments about 1.0 $h^{-1}$ to about 4.0 $h^{-1}$; and a hydrogen feed rate in the range of from about 100 standard liters of hydrogen per liter of oil (SLt/Lt) to about 1000 SLt/Lt, and in certain embodiments about 100 SLt/Lt to about 300 SLt/Lt.

The feedstream to the process can include thermally cracked distillates, fluid catalytic cracking distillates, naphthas, straight run gas oil, and refinery intermediate streams containing olefins and/or diolefins, and combinations thereof. In some embodiments, the feedstream has a boiling point in the range of from about 36° C. to 450° C. Typical feeds include a sulfur content in the range of from 0.1 W % to 3 W %. The desulfurized product will typically have a reduced sulfur content in the range of from 10-500 ppm.

Example 1

In accordance with Embodiment 4 described above, a feedstream that is a blend of coker naphtha and straight run naphtha, the composition and properties of which are identified in Table 3, was subjected to mercaptanization, and thiophenization and mercaptan oxidation processing steps in order to provide an intermediate stream that is substantially free of olefins and diolefins. The intermediate stream was then subjected to hydrodesulfurization processing. The coker naphtha was obtained from the delayed coking of a desulfurized vacuum residue.

TABLE 3

| Property | Unit | Coker naphtha | Straight run naphtha | Blend |
|---|---|---|---|---|
| Volume % | % | 30 | 70 | 100 |
| API Gravity | ° | 65.2 | 61.4 | 62.4 |
| Density | g/cc | 0.7194 | 0.734 | 0.730 |
| Sulfur | ppmw | 1126 | 960 | 1010 |
| Nitrogen | ppmw | 24 | 3 | 9 |

TABLE 3-continued

| Property | Unit | Coker naphtha | Straight run naphtha | Blend |
|---|---|---|---|---|
| Aromatics | wt % | 12.2 | 6.0 | 7.9 |
| Olefins | wt % | 37.0 | 0.0 | 11.1 |
| Diolefins | wt % | 5.5 | 0.0 | 1.7 |
| Bromine number | g/100 g | 74 | 0.0 | 22[1] |
| Maleic Diene Value | mg/g | 7.6 | 0 | 2.28[1] |
| | | SIMDIST | | |
| 0/5 | ° C. | −3 | 41 | 28 |
| 10 | ° C. | 40 | 49 | 46 |
| 50 | ° C. | 101 | 114 | 110 |
| 90 | ° C. | 144 | 180 | 169 |
| 95/100 | ° C. | 167 | 187 | 181 |

[1]calculated

From Table 3, it is clear that the starting coker naphtha feed contains a relatively high concentration of diolefins (5.5 wt %) and olefins (37.0 wt %) with a maleic anhydride diene test value of 7.6 mg/g. When blended with the straight run naphtha, the maleic anhydride diene test value is lowered to a value of 2.28 mg/g. The blend was thiophenized and mercaptanized with hydrogen sulfide in a fixed-bed reactor, each at a temperature of 200° C., and a pressure of 15 bars. The hydrogen sulfide was generated in situ by the decomposition of DMDS with hydrogen over a catalyst bed in the same reactor.

The material balance for the process of Example 1 is shown in Table 4. When 100 kg of the naphtha blend was processed according to Embodiment 3, 99.8 kg of desulfurized naphtha was recovered, indicating that the process is effective at desulfurizing olefin and diolefin containing feed streams.

TABLE 4

| Stream # | Description | Mass Flow Kg/h | Diolefins Kg/h | Olefins Kg/h | Thiophenes Kg/h | Mercaptans Kg/h | Sulfur Kg/h |
|---|---|---|---|---|---|---|---|
| 502 | Unsaturated hydrocarbon feed (Naphtha blend) | 100.0 | 1.7 | 11.1 | | | 0.101 |
| 504 | Hydrogen Disulfide | 8.9 | | | | | |
| 512 | Thiophenized effluent stream | 108.9 | | | 2.5 | | 0.867 |
| 522 | Mercaptanized and thiophenized effluent stream | 108.8 | | | | 14.6 | 4.283 |
| 532 | Hydrogen sulfide recycle | 4.4 | | | | | |
| 542 | Mercaptanized and thiophenized effluent stream | 104.3 | | | | | 4.283 |
| 544 | Hydrogen | 2.7 | | | | | |
| 574 | Off gases | 5.5 | | | | | 5.535 |
| 572 | Desulfurized product (desulfurized naphtha) | 98.8 | | | | | 0.001 |

It will be understood from the above description that the present disclosure provides a cost-effective process for pretreating feeds that contain olefins and diolefins prior to the catalytic hydrodesulfurization of the distillate streams.

The process of the present invention has been described above and in the attached figures; process modifications and variations will be apparent to those of ordinary skill in the art from this description and the scope of protection is to be determined by the claims that follow.

The invention claimed is:

1. A process for treating a sulfur-containing refinery feedstock of unsaturated hydrocarbons comprising olefins that has a maleic anhydride diene test value that is less than 4 g/100 g oil, the process comprising:

a. introducing the unsaturated hydrocarbon feedstock and hydrogen sulfide into an unsaturated hydrocarbon treatment zone containing a catalyst for reaction of the $H_2S$ with the olefins to produce a treated effluent stream, wherein the unsaturated hydrocarbon treatment zone comprises a mercaptanization unit; and b. passing the treated effluent stream to a hydrodesulfurization zone to produce a desulfurized hydrocarbon stream.

2. The process of claim 1, wherein the unsaturated hydrocarbon treatment zone comprises a thiophenization unit.

3. The process of claim 1, wherein the treated effluent stream of step (a) is passed to a hydrogen sulfide separation zone for the separation and recovery of a hydrogen sulfide recycle stream for use in step (a).

4. The process of claim 1, wherein an excess of hydrocarbon sulfide is introduced into the unsaturated hydrocarbon treatment zone and the desulfurized hydrocarbon stream is introduced into a gas-liquid separation zone for separation into an off-gas stream and a desulfurized product.

5. The process of claim 4, wherein the desulfurized product is recovered.

6. The process of claim 4, wherein the off-gas stream is recovered.

7. The process of claim 1, wherein the sulfur-containing feedstock comprising unsaturated hydrocarbons is selected from the group consisting of thermally cracked distillates, fluid catalytic cracking distillates, naphthas, straight run gas oil, and refinery intermediate streams containing olefins and/or diolefins, and combinations thereof.

8. The process of claim 1, wherein the treated effluent stream is substantially free of olefins and has a bromine number of less than 1 g/100 g oil.

9. The process of claim 1, wherein the sulfur-containing feedstock comprising unsaturated hydrocarbons has a boiling point in the range of from 36° C. to 450° C.

10. The process of claim 1, wherein the sulfur-containing feedstock comprising unsaturated hydrocarbons has a sulfur content in the range of from 0.1 W % to 3 W %.

11. The process of claim 1, wherein the desulfurized hydrocarbon stream has a sulfur content in the range of from 10-500 ppm.

12. The process of claim 1, wherein the unsaturated hydrocarbon treatment zone contains a catalyst that is an active phase metal catalyst where the metal is selected from Periodic Table Groups 4-11 and is carried by an alumina, silica, silica-alumina, titania, or zeolite support.

13. The process of claim 1, wherein the hydrodesulfurization zone contains a catalyst having one or more active metal components selected from Periodic Table Groups 6-10 and is carried by an alumina, silica alumina, silica, or zeolite support.

14. The process of claim 1, wherein the hydrodesulfurization zone operates at a temperature of 420° C. and below, a hydrogen partial pressure of 80 bars and below, and a hydrogen feed rate of or below 1000 liters per liter of oil.

15. A process for treating a sulfur-containing refinery feedstock of unsaturated hydrocarbons comprising olefins and diolefins that have a maleic anhydride diene test value that is greater than or equal to 4 g/100 g, the process comprising:

a. introducing the unsaturated hydrocarbon feedstock and hydrogen sulfide into an unsaturated hydrocarbon treatment zone containing a catalyst for reaction of the $H_2S$ with the olefins and diolefins to produce a treated effluent stream, wherein the unsaturated hydrocarbon treatment zone comprises a mercaptanization unit;

b. passing the treated effluent stream to a mercaptan oxidation unit treatment to produce a disulfide oil product stream and a treated raffinate stream;

c. recovering the disulfide oil product stream; and d. passing the treated raffinate stream to a hydrodesulfurization zone to produce a desulfurized hydrocarbon stream.

16. The process of claim 15, wherein the conversion in step (a) comprises:

introducing the unsaturated hydrocarbon feedstock and hydrogen sulfide into a thiophenization unit for conversion of diolefins into thiophenes to produce a thiophenized effluent stream;

introducing the thiophenized effluent stream and hydrogen sulfide into the mercaptanization unit for conversion of olefins into mercaptans and recovering a mercaptanized and thiophenized effluent stream, wherein the mercaptanized and thiophenized effluent stream is the treated effluent stream of step (b).

17. The process of claim 16, wherein the thiophenized effluent stream is substantially free of diolefins and has a maleic anhydride diene value of less than 4 g/100 g oil.

18. The process of claim 16, wherein the mercaptanized and thiophenized effluent stream is substantially free of diolefins and olefins and has a maleic anhydride diene value of less than 4 g/100 g oil and a bromine number of less than 1 g/100 g oil.

19. The process of claim 15, wherein the unsaturated hydrocarbon treatment zone comprises a thiophenization unit.

20. The process of claim 15, wherein the treated effluent stream is substantially free of olefins and has a bromine number of less than 1 g/100 g oil.

21. The process of claim 15, wherein the treated effluent stream of step (a) is passed to a hydrogen sulfide separation zone for the separation and recovery of a hydrogen sulfide recycle stream for use in step (a).

22. The process of claim 15, wherein an excess of hydrocarbon sulfide is introduced into the unsaturated hydrocarbon treatment zone and the desulfurized hydrocarbon stream is introduced into a gas-liquid separation zone for separation into an off-gas stream and a desulfurized product.

23. The process of claim 22, wherein the desulfurized product is recovered.

24. The process of claim 22, wherein the off-gas stream is recovered.

25. The process of claim 15, wherein the sulfur-containing feedstock comprising unsaturated hydrocarbons is selected from the group consisting of thermally cracked distillates, fluid catalytic cracking distillates, naphthas, straight run gas oil, and refinery intermediate streams containing olefins and/or diolefins, and combinations thereof.

26. The process of claim 15, wherein the sulfur-containing feedstock comprising unsaturated hydrocarbons has a boiling point in the range of from 36° C. to 450° C.

27. The process of claim 15, wherein the sulfur-containing feedstock comprising unsaturated hydrocarbons has a sulfur content in the range of from 0.1 W % to 3 W %.

28. The process of claim 15, wherein the desulfurized hydrocarbon stream has a sulfur content in the range of from 10-500 ppm.

29. The process of claim 15, wherein the unsaturated hydrocarbon treatment zone contains a catalyst that is an active phase metal catalyst where the metal is selected from Periodic Table Groups 4-11 and is carried by an alumina, silica, silica-alumina, titania, or zeolite support.

30. The process of claim 15, wherein the hydrodesulfurization zone contains a catalyst having one or more active metal components selected from Periodic Table Groups 6-10 and is carried by an alumina, silica alumina, silica, or zeolite support.

31. The process of claim 15, wherein the hydrodesulfurization zone operates at a temperature of 420° C. and below, a hydrogen partial pressure of 80 bars and below, and a hydrogen feed rate of or below 1000 liters per liter of oil.

* * * * *